US011203504B2

(12) United States Patent
Suzuki

(10) Patent No.: US 11,203,504 B2
(45) Date of Patent: Dec. 21, 2021

(54) RECORDING APPARATUS

(71) Applicant: SEIKO EPSON CORPORATION, Tokyo (JP)

(72) Inventor: Yuto Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 16/416,401

(22) Filed: May 20, 2019

(65) Prior Publication Data

US 2019/0359441 A1 Nov. 28, 2019

(30) Foreign Application Priority Data

May 23, 2018 (JP) ..... JP2018-098917

(51) Int. Cl.
*B65H 31/26* (2006.01)
*B65H 31/36* (2006.01)
*B41J 13/10* (2006.01)

(52) U.S. Cl.
CPC ..... *B65H 31/36* (2013.01); *B41J 13/106* (2013.01); *B65H 31/26* (2013.01); *B65H 2405/1134* (2013.01); *B65H 2405/11151* (2013.01)

(58) Field of Classification Search
CPC ..... B65H 31/26; B65H 29/70; B65H 2405/11151; B65H 31/36; B65H 2405/1134
See application file for complete search history.

(56) References Cited

U.S. PATENT DOCUMENTS 8,408,540 B2 * 4/2013 Uchiyama ..... B65H 31/26 271/220
9,162,840 B1 * 10/2015 Ohta ..... B65H 31/34
2016/0264372 A1 * 9/2016 Yamamoto ..... B65H 31/02
2017/0050450 A1 * 2/2017 Chiba ..... B41J 13/106
2017/0160690 A1 * 6/2017 Sato ..... B65H 29/125
2020/0339370 A1 * 10/2020 Kotani ..... B65H 37/00

FOREIGN PATENT DOCUMENTS

JP 2012-193042 A 10/2012
JP 2013-032197 A 2/2013

* cited by examiner

*Primary Examiner* — Howard J Sanders
(74) *Attorney, Agent, or Firm* — Workman Nydegger

(57) ABSTRACT

A recording apparatus includes a recording head; an output unit that outputs the recording medium; an output tray that receives the recording medium; a pressing member that is configured to be displaced in an up-down direction and that presses the recording medium toward the output tray by displacement of the pressing member from an upper side to a lower side with respect to the recording medium; and a restricting member configured to contact an upstream end portion in an output direction of the recording medium pressed by the pressing member, the restricting member including a contact position thereof with respect to the upstream end portion being configured to rotate. The restricting member restricts deformation of the upstream end portion pressed by the pressing member at the contact position. The pressing member is displaced upward in a state in which the restricting member restricts the deformation of the upstream end portion.

8 Claims, 11 Drawing Sheets

RECORDING APPARATUS

The present application is based on, and claims priority from JP Application Serial Number 2018-098917, filed May 23, 2018, the disclosure of which is hereby incorporated by reference herein in its entirety.

BACKGROUND

1. Technical Field

The present disclosure relates to a recording apparatus.

2. Related Art

Hitherto, recording apparatuses having various configurations are used. Among such recording apparatuses, a recording apparatus configured such that a recording medium on which recording was performed is stacked on an output tray is used.

For example, JP-A-2013-32197 discloses an image forming apparatus (recording apparatus) configured such that a sheet (recording medium) on which recording was performed is stacked on a sheet output tray (output tray). The image forming apparatus includes a movable tray portion and a sheet press member.

When recording is performed on a recording medium, the recording medium may be deformed or specifically curved due to, for example, the influence of moisture in ink. Hence, with the recording apparatus configured such that the recording medium on which recording was performed is stacked on the output tray, the recording medium output on the output tray may be deformed and stacking efficiency for recording media may be decreased. The image forming apparatus of JP-A-2013-32197 includes the sheet press member. When a new sheet is stacked, the movable tray portion is lowered and the sheet press member is rotated to press the new sheet. The sheet is in an unpressed state while the sheet press member is rotated. Because the unpressed state of the sheet occurs, the sheet may be deformed while the sheet is not pressed, and the stacking efficiency may be decreased.

SUMMARY

An object of the present disclosure is to suppress deformation of a recording medium output on an output tray and to increase stacking efficiency for recording media.

According to an aspect of the present disclosure, a recording apparatus includes a recording head that performs recording by ejecting liquid on a recording medium; an output unit that outputs the recording medium on which the recording was performed by the recording head; an output tray that receives, from below, the recording medium output from the output unit in an output direction; a pressing member that is configured to be displaced in an up-down direction and that presses the recording medium toward the output tray by displacement of the pressing member from an upper side to a lower side with respect to the recording medium output from the output unit; and a restricting member configured to contact, from above, an upstream end portion in the output direction of the recording medium pressed by the pressing member, the restricting member including a contact position thereof with respect to the upstream end portion being configured to rotate. The restricting member restricts deformation of the upstream end portion in the output direction of the recording medium pressed by the pressing member at the contact position. The pressing member is displaced upward in a state in which the restricting member restricts the deformation of the upstream end portion.

With the aspect, the pressing member that is configured to be displaced in the up-down direction and that presses the recording medium toward the output tray, and the restricting member configured to contact, from above, the upstream end portion of the recording medium pressed by the pressing member, the restricting member including the contact position with respect to the upstream end portion being configured to rotate, are provided. Accordingly, deformation of the recording medium can be suppressed by at least one of the pressing member and the restricting member, and occurrence of a state in which deformation of the recording medium is not suppressed can be suppressed. Thus, deformation of the recording medium output on the output tray can be suppressed and stacking efficiency for recording media can be increased.

In the recording apparatus according to the present disclosure, during the displacement of the pressing member from the upper side to the lower side with respect to, end portions of the pressing member are lower than a center portion of the pressing member in a width direction intersecting with the output direction, the pressing member contacts from above the recording medium being output from the output unit, and hence the pressing member may be configured to form a curved shape protruding upward in a view in the output direction at the recording medium.

With the aspect, the pressing member contacts the end portions of the recording medium being output from the output unit such that the end portions of the recording medium are lower than the center portion of the recording medium in the width direction, and hence the pressing member is configured to form the curved shape extending in the output direction and protruding upward at the recording medium. Accordingly, deformation of the recording medium can be suppressed and stacking efficiency for recording media can be increased by stacking the recording medium while forming the curved shape extending along the output direction and protruding upward at the recording medium.

In the recording apparatus according to the present disclosure, the pressing member may be configured to press the upstream end portion of the recording medium toward the output tray by displacement of the pressing member from a position at which the pressing member contacts the recording medium having the curved shape to a pressing position, and the restricting member may be configured to rotate from the contact position along with the displacement of the pressing member to the pressing position.

With the aspect, the pressing member is configured to press the upstream end portion toward the output tray by the displacement of the pressing member to the pressing position at which the pressing member is configured to contact the upstream end portion of the recording medium having the curved shape. Accordingly, deformation of the recording medium along the output direction can be effectively suppressed and stacking efficiency for recording media can be increased by pressing the upstream end portion toward the output tray. In addition, the restricting member is configured to rotate from the contact position, that is, configured to be retracted along with the displacement of the pressing member to the pressing position. Accordingly, occurrence of an unpressed state of the recording medium can be suppressed by retracting the restricting member after the recording medium is pressed by the pressing member.

In the recording apparatus according to the present disclosure, the pressing member may be configured to restrict the deformation of the upstream end portion by displacement of the pressing member to a restricting position that is lower than the pressing position, and the restricting member may be configured to rotate to the contact position along with the displacement of the pressing member to the restricting position.

With the aspect, the pressing member is configured to restrict the deformation of the upstream end portion by the displacement of the pressing member to the restricting position that is lower than the pressing position. Accordingly, deformation of the recording medium along the output direction can be effectively suppressed and stacking efficiency for recording media can be increased by restricting the deformation of the upstream end portion using the pressing member. In addition, the restricting member is configured to rotate to the contact position along with the displacement of the pressing member to the restricting position. Accordingly, deformation of a newly stacked recording medium can be restricted using the restricting member by arranging the restricting member at the contact position after the recording medium is restricted by the pressing member.

In the recording apparatus according to the present disclosure, the restricting member may be flexible.

With the aspect, since the restricting member is flexible, when a recording medium is newly stacked, the operation of rotating the restricting member by one turn and bringing the restricting member into contact with the new recording medium can be easily executed.

The recording apparatus according to the present disclosure may further include a lifting/lowering mechanism of the output tray. The lifting/lowering mechanism is configured to adjust a position of the output tray such that the restricting member in contact with the recording medium stacked on the output tray is bent and rotatable at the contact position.

With the aspect, the position of the output tray can be adjusted such that the flexible restricting member located at the contact position is bent and rotatable. Accordingly, the restricting member can be smoothly rotated for effectively suppressing deformation along the output direction of a stacked recording medium by the restricting member, and for suppressing deformation along the output direction of a recording medium to be newly stacked.

The recording apparatus according to the present disclosure may further include a casing portion that houses the recording head. In the recording apparatus, the output tray and the lifting/lowering mechanism may be housed in the casing portion.

With the aspect, since the output tray and the lifting/lowering mechanism are housed in the casing portion, for example, contact of the output tray with an external object along with movement (lifting or lowering) of the output tray can be suppressed.

In the recording apparatus according to the present disclosure, the output tray may have a rib that is provided at a center portion of the output tray in a width direction intersecting with the output direction and that extends along the output direction, and the pressing member is configured to press the recording medium toward the output tray at both sides of the rib in the width direction, the both sides being configured to be displaced to a position lower than a top portion of the rib.

With the aspect, the recording medium output on the output tray can be curved along the rib, that is, along the output direction. Accordingly, deformation of the recording medium can be suppressed and stacking efficiency for recording media can be increased by stacking the recording medium while forming the curved shape along the output direction at the recording medium.

DESCRIPTION OF EXEMPLARY EMBODIMENTS

A recording apparatus 1 according to an embodiment of the present disclosure is described below in detail with reference to the accompanying drawings. In the following description, an ink jet printer is described as an example of the recording apparatus 1 according to the present disclosure.

Ink jet systems include various types, such as a type of mounting an ink cartridge on a carriage and a type of providing an ink housing portion outside a carriage and coupling the ink housing portion and the carriage to each other via an ink tube. The present disclosure can be applied to any type. The recording apparatus 1 of this embodiment is the type of providing the ink housing portion outside the carriage and coupling the ink housing portion and the carriage to each other via the ink tube.

In the X-Y-Z coordinate system in each drawing, the X-axis direction indicates a direction in which a front surface and a rear surface of the apparatus face each other, and a medium-width direction; the Y-axis direction indicates a medium transport direction when recording is performed on a recording medium, and a direction in which side surfaces of the apparatus face each other; and the Z-axis direction indicates a height direction of the apparatus and the gravity direction. The direction to which a recording medium is transported is referred to as "downstream" and the opposite direction is referred to as "upstream". In each drawing, part of components is occasionally omitted or simplified for easier understanding of the inside configuration and so forth.

Figure 1:
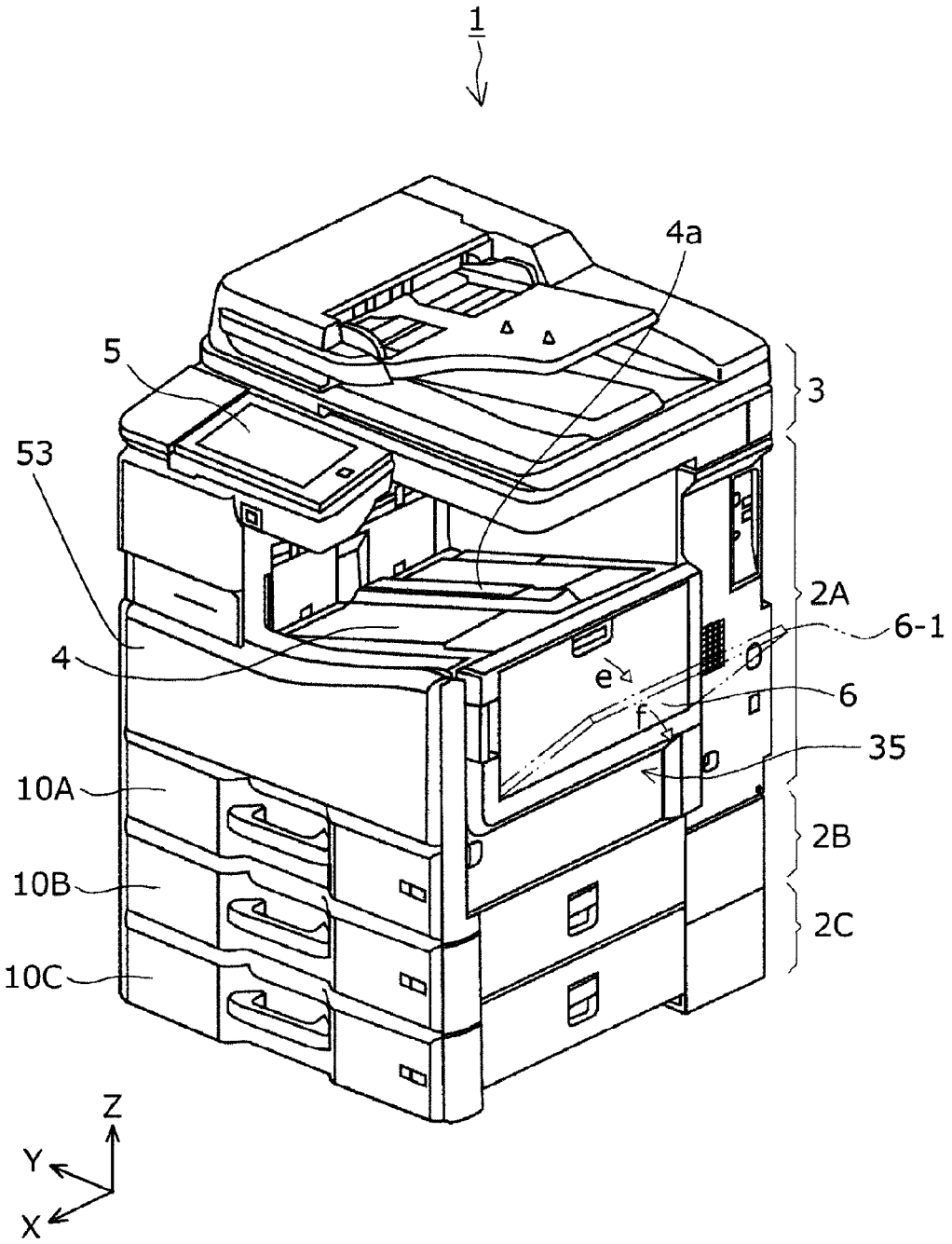
FIG. 1 is a schematic perspective view of a recording apparatus according to an embodiment of the present disclosure.
Figure 2:
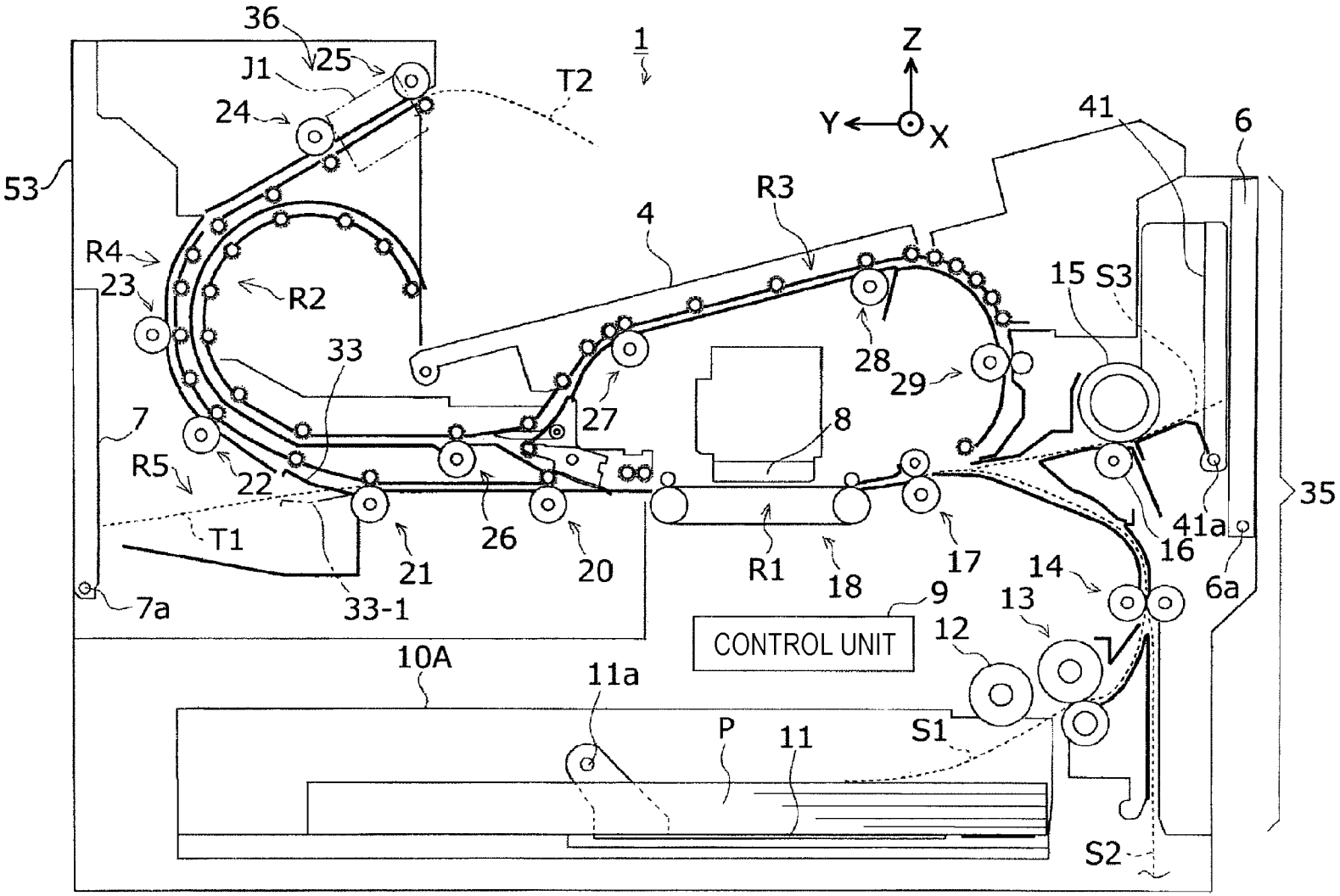
FIG. 2 is a schematic front sectional view of the recording apparatus according to the embodiment of the present disclosure.

A general configuration of the recording apparatus 1 is briefly described first with reference to FIGS. 1 and 2.

FIG. 1 is a schematic perspective view of the recording apparatus 1 of this embodiment. FIG. 2 is a schematic front sectional view of the recording apparatus 1 of this embodiment. FIGS. 1 and 2 omit a pressing member 50 and a restricting member 51, which are principal parts of the recording apparatus 1 and are illustrated in FIGS. 3 to 14, to give a higher priority to description on the general configuration of the recording apparatus 1. The details of the pressing member and the restricting member are described later after the description on the general configuration of the recording apparatus 1.

In FIG. 1, the recording apparatus 1 includes a scanner unit 3 located above an apparatus body 2A that performs recording on a sheet P serving as a recording medium, and includes additional units 2B and 2C located below the apparatus body 2A. The apparatus body 2A includes a sheet cassette 10A. The additional unit 2B includes a sheet cassette 10B. The additional unit 2C includes a sheet cassette 10C. The additional units 2B and 2C are optional units for increasing the number of housed sheets, and are attached to the apparatus body 2A as desired.

The recording apparatus 1 of this embodiment includes an operation unit 5 with which various operations are performed, an output tray 4 that receives a sheet P on which recording was performed and which is output, and a feed unit 35 that can be opened and closed with respect to the apparatus body 2A by pivoting on a pivot axis (not illustrated). To be more specific, the output tray 4 is a face-down output tray that receives a sheet P which is output such that a recording surface on which recording was performed most recently faces down.

The recording apparatus 1 includes an opening/closing cover 6 that constitutes the feed unit 35. As illustrated in FIG. 2, the opening/closing cover 6 pivots on a pivot shaft 6*a* and can be opened in directions indicated by arrows e and f in FIG. 1. In FIG. 1, an opening/closing cover 6-1 illustrated by imaginary lines indicates the opening/closing cover 6 in the middle of opening or closing.

As illustrated in FIG. 2, a manual feed tray 41 is provided inside the opening/closing cover 6. The manual feed tray 41 pivots on a pivot shaft 41*a* and can be opened and closed together with the opening/closing cover 6. The manual feed tray 41 illustrated in FIG. 2 is in a housed posture. The manual feed tray 41 is opened clockwise from the state in FIG. 2, and can manually feed a sheet in a state in which the manual feed tray 41 faces obliquely upward.

The side of the recording apparatus 1 arranged with the operation unit 5 is an apparatus front side, and the side thereof provided with the opening/closing cover 6 is an apparatus right side. A sheet P is fed, transported, and output along an apparatus left-right direction in the recording apparatus 1.

A sheet transport path in the recording apparatus 1 is briefly described next with reference to FIG. 2. The recording apparatus 1 has three sheet feed paths including a feed path from the sheet cassette 10A (see a cassette feed locus S1), a feed path from the sheet cassettes 10B and 10C not illustrated in FIG. 2 (see an additional cassette feed locus S2), and a feed path from the manual feed tray 41 on which a sheet P is placed (see a manual feed path S3).

In addition, the recording apparatus 1 has two sheet output methods of face-up output of outputting a sheet such that a recording surface on which recording was performed most recently faces up (see a face-up output locus T1), and face-down output of outputting a sheet such that a recording surface on which recording was performed most recently faces down (see a face-down output locus T2).

The recording apparatus 1 includes a face-up output tray 7 that receives a sheet P output face up as illustrated in FIG. 2. The face-up output tray 7 pivots on a pivot shaft 7*a* to be set to a housed state illustrated in FIG. 2 and an open state (not illustrated).

The recording apparatus 1 has five sheet transport paths including a recording transport path R1, a switch-back path R2, an inversion path R3, a face-down output path R4, and a face-up output path R5.

The recording apparatus 1 includes a flap (path switching member) 33 that is driven by a driving source (not illustrated). The flap 33 switches the state between a state indicated by a solid line in FIG. 2 and a state indicated by an imaginary line of a flap 33-1. When the flap 33 is in the state indicated by the solid line in FIG. 2, a sheet P is guided to the face-down output path R4, and is output face down as indicated by the face-down output locus T2. The most downstream portion of the face-down output path R4 is constituted by an output mechanism unit 36. In a region J1 in FIG. 2, a plurality of driven rollers (spurs) are provided. When the flap 33 is in the state indicated by the imaginary line in FIG. 2, a sheet P is guided to the face-up output path R5, and is output face up as indicated by the face-up output locus T1.

A control unit 9 that performs various control acquires recording data that is data for recording generated by a printer driver operable in an external computer (not illustrated) or a printer driver included in the control unit 9. The control unit 9 controls an ink jet recording head (hereinafter, "recording head") 8, transport rollers for various types of sheets driven by a motor (not illustrated), and path switching members (flaps) in accordance with the recording data. The control unit 9 also performs required control based on the detection states of various sensors such as a sensor that detects passing of a sheet P. FIG. 2 conceptually illustrates the control unit 9. The control unit 9 is actually constituted by a circuit board provided at a predetermined position in the apparatus body 2A.

A sheet feed path to a registration roller pair 17 is described here.

The sheet cassette 10A removably provided at the apparatus body 2A includes a hopper 11. When the hopper 11 swings about a shaft 11*a*, a sheet housed in the sheet cassette 10A comes into contact with or is separated from a feed roller 12 that is rotationally driven by a motor (not illustrated).

The sheet P fed from the sheet cassette 10A by the feed roller 12, in a state in which the sheet P is separated when passing through a nip position provided by a separation roller pair 13 and multifeed is prevented, receives a feed force from a transport roller pair 14 and reaches the registration roller pair 17. The additional units 2B and 2C located below the apparatus body 2A each include a feed roller 12 and a separation roller pair 13 likewise. A sheet P fed from each sheet cassette receives a feed force from a transport roller pair 14 illustrated in FIG. 2, and reaches the registration roller pair 17. In addition, a feed roller 15 and a separation roller 16 are provided in the sheet feed path (the manual sheet feed path S3) from the manual feed tray 41. A sheet P set on the manual feed tray 41 reaches the registration roller pair 17 by the rotation of these rollers.

First to fourth transport paths that define a sheet transport path located downstream of the registration roller pair 17 are described next based on an assumption that a sheet P is output face down through the face-down output path R4.

The sheet transport path is provided with the registration roller pair 17, transport roller pairs 20 to 24, transport roller pairs 26 to 29, and an output roller pair 25 serving as an output unit that outputs a sheet P. The output roller pair 25 provided most downstream of the face-down output path R4 constitutes the output unit that outputs the sheet P from the face-down output path R4.

Each roller pair includes a driving roller that is driven by a motor (not illustrated) and a driven roller that can nip a sheet P between the driven roller and the driving roller and that is rotated while being in contact with the sheet P. For the driving roller, for example, a plurality of rubber rollers provided at proper intervals in a sheet-width direction may be used. For the driven roller, for example, a serrated roller having a plurality of teeth on its outer periphery may be used.

The recording transport path R1 serving as the first transport path passes below the recording head 8 serving as a recording unit that performs recording on a sheet P, and extends to the upstream and downstream of the recording head 8. A sheet P receives feed forces from the registration roller pair 17 and a belt unit 18 in the recording transport path R1.

The recording head 8 of this embodiment is a recording head (what is called line head) in which nozzles that eject ink are provided to cover the entire region in the sheet-width direction. The recording head 8 is configured as a recording head that can perform recording entirely for the sheet width without movement in the sheet-width direction. However, the recording head 8 is not limited to the line head as far as the recording head 8 performs recording by ejecting liquid such as ink on a recording medium.

The switch-back path R2 serving as the second transport path is a transport path coupled to the recording transport path R1, and is a path in which the sheet P passing below the recording head 8 is initially fed leftward in FIG. 2, then is switched back, and is transported rightward in FIG. 2 that is the direction opposite to the initial feed direction. The switch-back path R2 is located inside a curve of the face-down output path R4 (described later). The sheet P in the switch-back path R2 receives a feed force from the transport roller pair 26.

The inversion path R3 serving as the third transport path is a transport path coupled to the switch-back path R2. In the inversion path R3, the sheet P transported in the opposite direction or rightward in FIG. 2 passes above the recording head 8 to be inverted, and is joined to the recording transport path R1 at a position located upstream of the recording head 8, that is, a position located upstream of the registration roller pair 17 in this embodiment. The sheet P in the inversion path R3 receives feed forces from the transport roller pairs 27, 28, and 29.

The face-down path R4 serving as the fourth transport path is a transport path coupled to the recording transport path R1, and is a path in which the sheet P passing below the recording head 8 is curved such that a surface of the sheet P facing the recording head 8 faces inside, the sheet P is inverted, and the sheet P is output. In the face-down output path R4, the sheet P receives feed forces from the transport roller pairs 20, 21, 22, 23, and 24, and the output roller pair 25. The most downstream portion of the face-down output path R4 is constituted by the output mechanism unit 36 as described above.

A flap serving as a path switching member for switching the transport path is provided at the coupling portion of each transport path. With the flap, the path through which the sheet P is advanced is set.

The pressing member 50 and the restricting member 51 that are principal portions of the recording apparatus 1 are described next in detail with reference to FIGS. 3 to 7.

Figure 3:
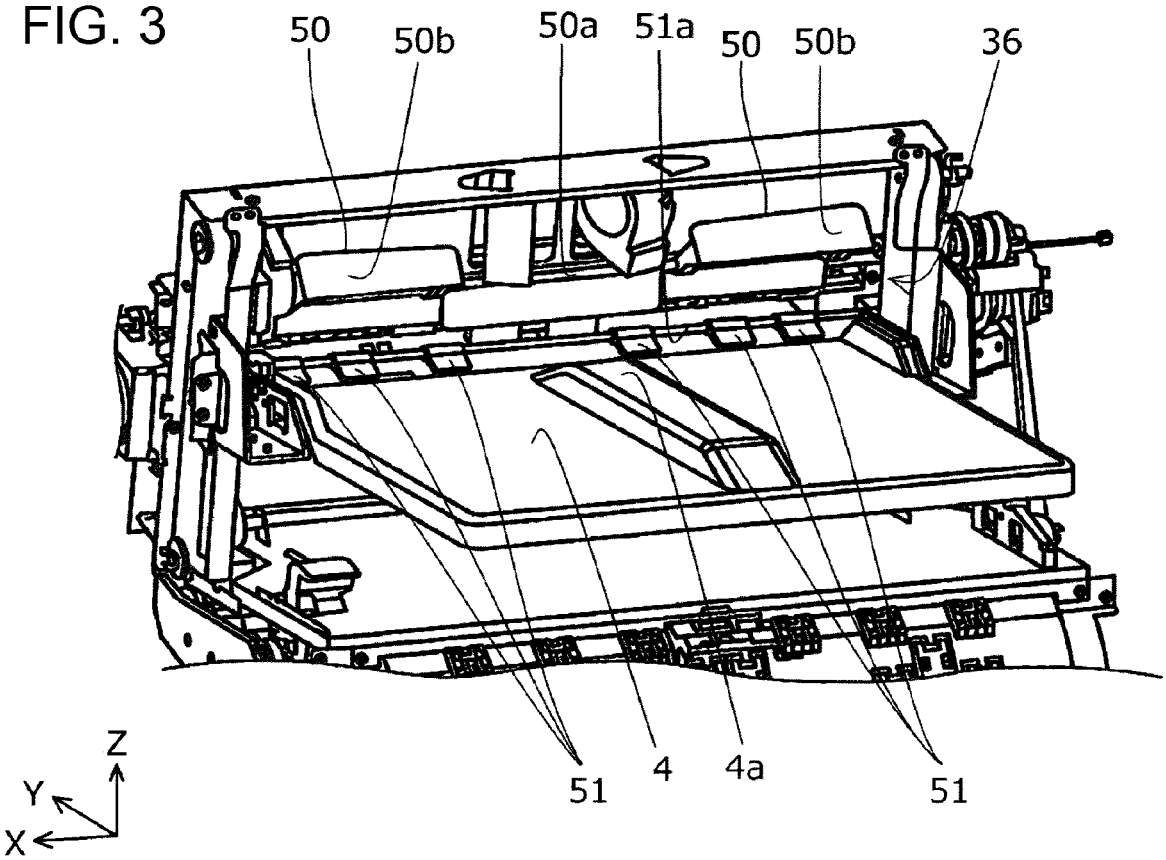
FIG. 3 is a schematic perspective view of the recording apparatus according to the embodiment of the present disclosure.
Figure 4:
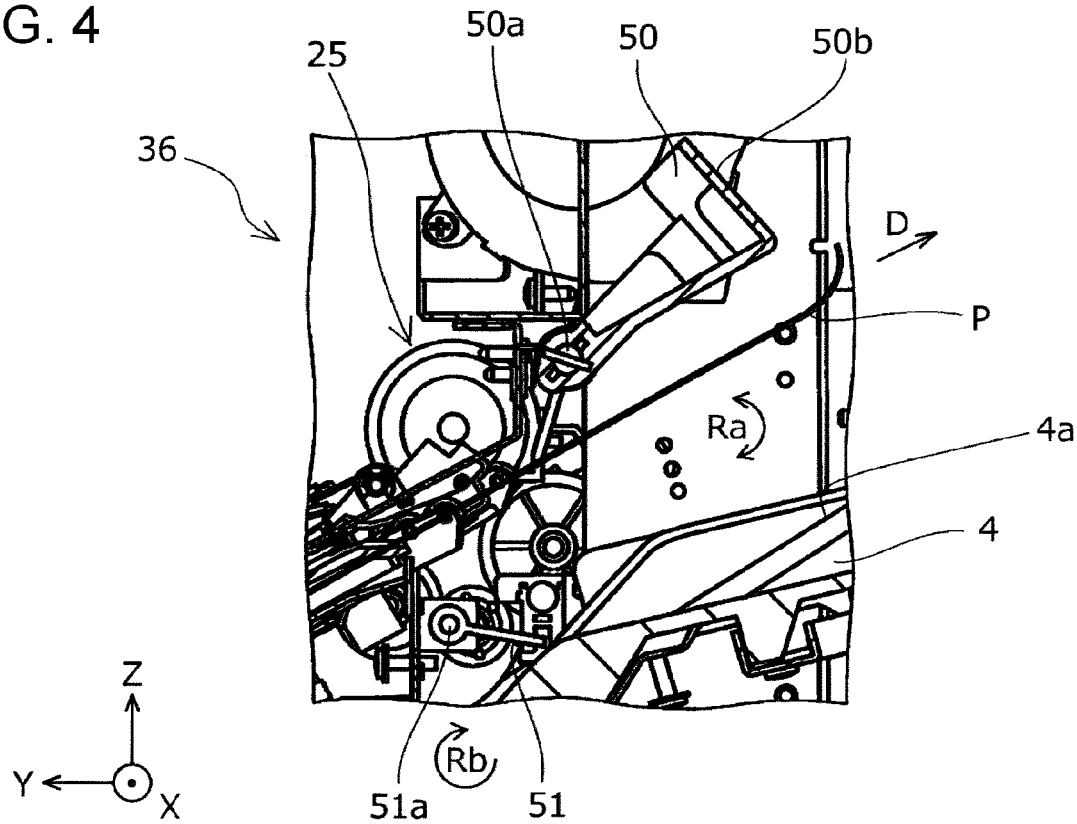
FIG. 4 is a schematic front sectional view of the recording apparatus according to the embodiment of the present disclosure.
Figure 5:
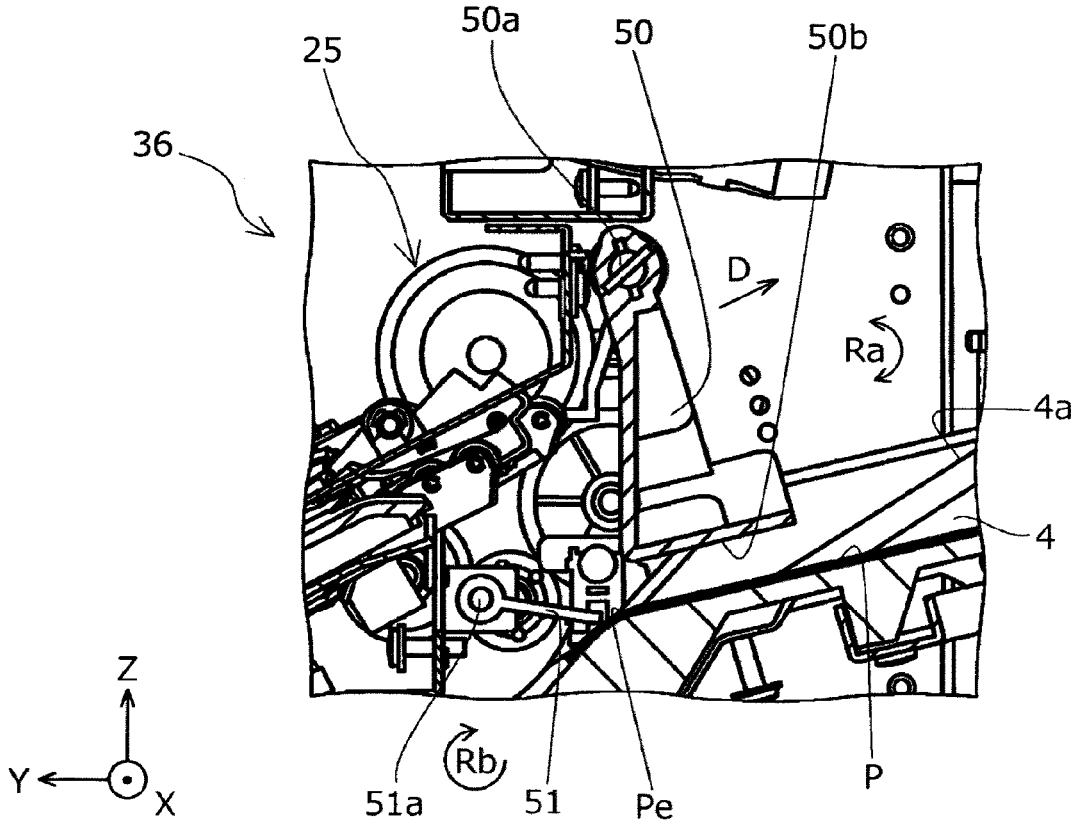
FIG. 5 is a schematic front sectional view of the recording apparatus according to the embodiment of the present disclosure.
Figure 6:
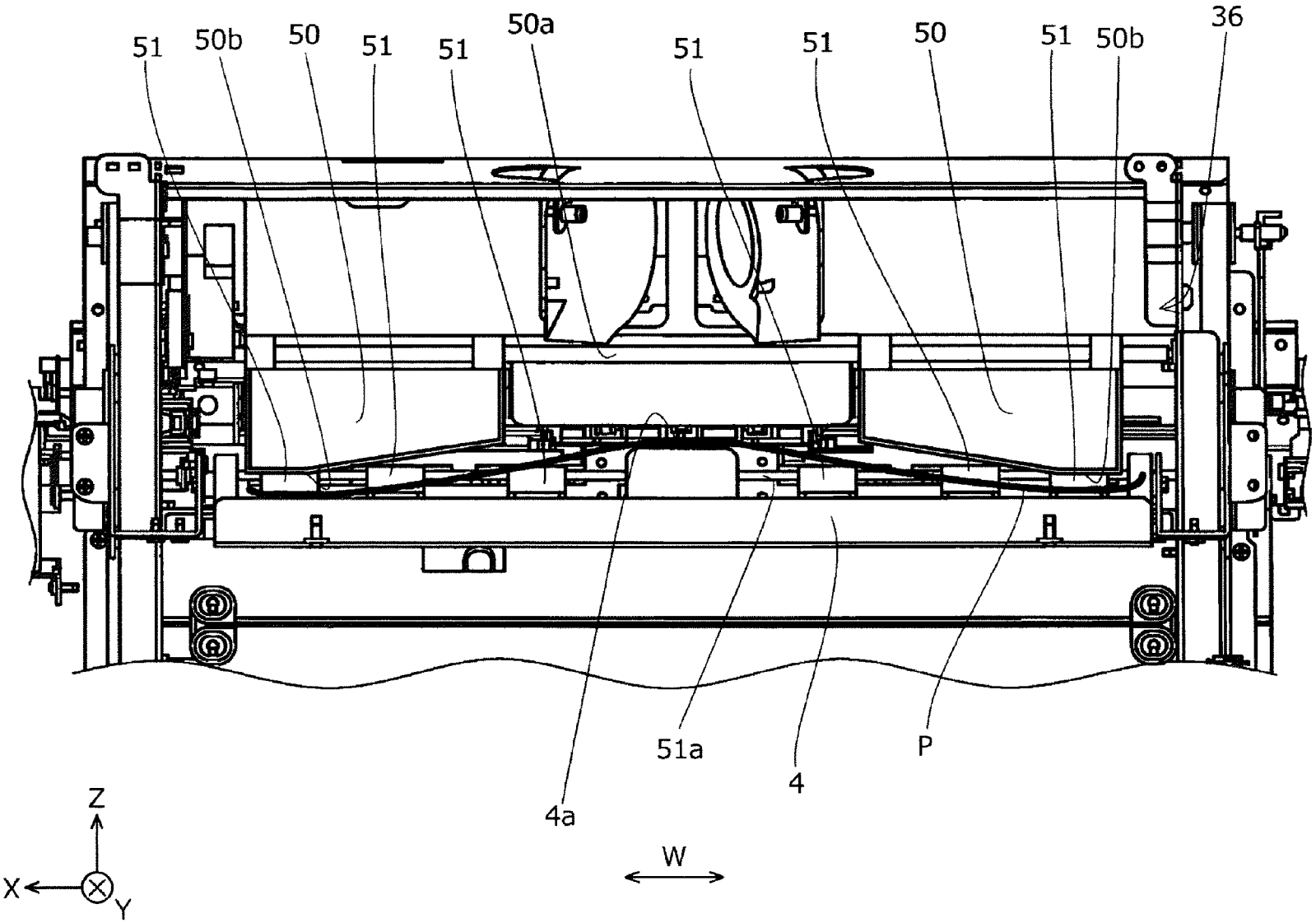
FIG. 6 is a schematic side view of the recording apparatus according to the embodiment of the present disclosure.
Figure 7:
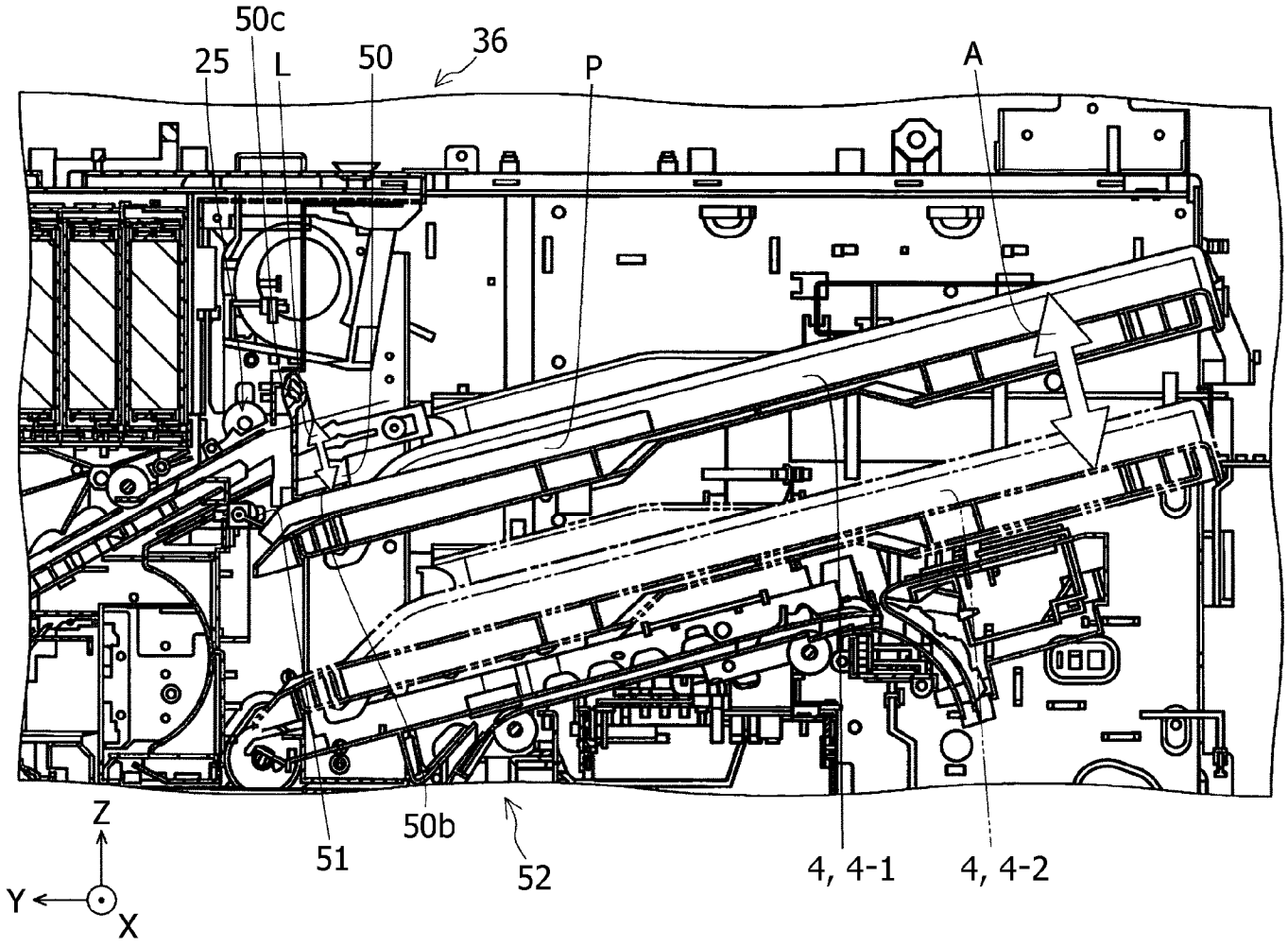
FIG. 7 is a schematic front sectional view of the recording apparatus according to the embodiment of the present disclosure.

FIG. 3 is a schematic perspective view of the recording apparatus 1 of this embodiment, and illustrates a state in which part of components, such as a casing portion 53 (see FIGS. 1 and 2) is removed. FIG. 4 is a schematic front sectional view of the recording apparatus 1 of this embodiment, and illustrates a state in which a sheet P starts being output from the output mechanism unit 36. FIG. 5 is a schematic front sectional view of the recording apparatus 1 of this embodiment, and illustrates a state in which output of the sheet P from the output mechanism unit 36 is completed. FIG. 6 is a schematic side view of the recording apparatus 1 of this embodiment, and illustrates a state in which output of the sheet P from the output mechanism unit 36 is completed. FIG. 7 is a schematic front sectional view of the recording apparatus 1 of this embodiment, and illustrates a state in which the output tray 4 is moved in accordance with the number of sheets P output on the output tray 4.

It is to be noted that FIGS. 3 to 7 illustrate a state in which the restricting member 51 is at a contact position with respect to an upstream end portion Pe in an output direction D of a sheet P.

As illustrated in FIGS. 3 to 7, the recording apparatus 1 includes the output tray 4 that receives, from below, a sheet P output from the output roller pair 25. The output tray 4 has a rib 4*a* that is formed to extend along the output direction D of the sheet P. When the sheet P output from the output roller pair 25 to the output tray 4 is noticeably deformed to curve in a view in a width direction W (a sheet-width direction) intersecting with the output direction D, a plurality of sheets P may not be properly stacked on the output tray 4. In the recording apparatus 1 of this embodiment, the output tray 4 has the rib 4*a* that extends along the output direction D and that curves a sheet P along the output direction D as illustrated in FIG. 6 to suppress noticeable deformation of the sheet P such as a curve in a view in the width direction W.

In addition, the recording apparatus 1 includes the pressing member 50 that presses a sheet P stacked on the output tray 4 toward the output tray 4, and the restricting member 51 that restricts deformation of an upstream end portion Pe in the output direction D of the sheet P as illustrated in FIG. 5. As understood through comparison between FIGS. 4 and 5, the pressing member 50 pivots in a pivot direction Ra on a pivot shaft 50*a*, and hence the pressing member 50 can be displaced in the up-down direction between a retracted position illustrated in FIG. 4 and a pressing position illustrated in FIG. 5 at which the pressing member 50 presses the upstream end portion Pe. The restricting member 51 rotates by one turn in a rotation direction Rb about a rotation shaft 51*a* from the state in FIG. 4, and hence the restricting member 51 can contact, from above, the upstream end portion Pe pressed by the pressing member 50 as illustrated in FIG. 5. Since the recording apparatus 1 of this embodiment is thus configured, the pressing member 50 and the restricting member 51 press the upstream end portion Pe of the sheet P and can effectively suppress noticeable deformation of the sheet P such as a curve in a view in the width direction W. It is to be noted that the "upstream end portion Pe" is not limited to the upstream leading end of the sheet P, and represents an area around an upstream leading end portion of the sheet P.

The recording apparatus 1 of this embodiment includes, as described above, the recording head 8 that performs recording by ejecting liquid on a sheet P, the output roller pair 25 that outputs the sheet P on which the recording was performed by the recording head 8, and the output tray 4 that receives, from below, the sheet P output from the output roller pair 25 in the output direction D; and the recording apparatus 1 further includes the pressing member 50 and the restricting member 51. In this case, the pressing member 50 can be displaced in the up-down direction, and by displacement thereof from an upper side to a lower side with respect to the sheet P output from the output roller pair 25, that is, by displacement thereof from the state illustrated in FIG. 4 to the state illustrated in FIG. 5, the pressing member 50 can press the sheet P toward the output tray 4. In addition, the restricting member 51 can contact, from above, the upstream end portion Pe in the output direction D of the sheet P pressed by the pressing member 50 as illustrated in FIG. 5, and the restricting member 51 including the contact position with respect to the upstream end portion Pe can rotate in the rotation direction Rb.

Since the recording apparatus 1 of this embodiment is thus configured, at least one of the pressing member 50 and the restricting member 51 can suppress deformation of the sheet P. In other words, the recording apparatus 1 of this embodiment can suppress occurrence of a state in which deformation of the sheet P is not restricted. Thus, the recording apparatus 1 of this embodiment suppresses deformation of a sheet P output on the output tray 4, for example, noticeable deformation of the sheet P such as a curve in a view in the width direction W, and increases stacking efficiency for sheets P. In addition, by rotation of the restricting member 51 of this embodiment in the rotation direction Rb, the restricting member 51 can cause a sheet P to be stacked in a manner aligned at the upstream in the output direction D of the output tray 4. However, the configuration is not limited to the one described above. The configuration may be any one as long as the configuration can contact, from above, the upstream end portion Pe, and the configuration including the contact position with respect to the upstream end portion Pe can rotate.

It is to be noted that "deformation of a sheet P" in this specification does not include a desirable deformation when a sheet P is deformed into a desirable shape, and represents deformation of a sheet P other than deformation into a desirable shape. For example, in a case where a sheet P is stacked on the output tray 4 while a curved shape extending along the output direction D and protruding upward is formed (described later), it can be said that the sheet P is deformed when the sheet P is further deformed from the curved shape extending along the output direction D and protruding upward. In addition, "being configured to contact from above" is not limited to being configured to contact from above in a vertical direction, and being configured to contact from a side opposite to the output tray 4 toward the output tray 4 satisfies "being configured to contact from above".

As illustrated in FIG. 6, the pressing member 50 of this embodiment is formed at a position near each of end portions of a sheet P in the width direction W (the sheet-width direction). The pressing members 50 of this embodiment can contact the end portions of the sheet P while being output from the output roller pair 25 so that the end portions of the sheet P are lower than a center portion of the sheet P in the width direction W. Since the pressing member 50 is thus configured, a curved shape extending along the output direction D and protruding upward is formed at the sheet P output on the output tray 4. Thus, the recording apparatus 1 of this embodiment suppresses deformation of a sheet P and increases stacking efficiency for sheets P, by stacking a sheet P while forming a curved shape extending along the output direction D and protruding upward at the sheet P.

The pressing member 50 of this embodiment is formed to be arranged such that the pressing member 50 does not interfere with the restricting member 51 although the restricting member 51 rotates in the rotation direction Rb when the pressing member 50 is located at the restricting position at which the pressing member 50 can restrict the upstream end portion Pe in the output direction D of the sheet P. Accordingly, the recording apparatus 1 of this embodiment can rotate the restricting member 51 in the rotation direction Rb in a state in which the pressing member 50 is located at the restricting position.

In this case, the restricting member 51 of this embodiment has flexibility. Accordingly, when a sheet P is newly stacked, the recording apparatus 1 of this embodiment can easily execute an operation of rotating the restricting member 51 by one turn and bringing the restricting member 51 into contact with the new sheet P. In other words, since the restricting member 51 is flexible, inhibition of rotation of the restricting member 51 caused by a deviation of the contact position of the restricting member 51 with respect to the sheet P due to a design tolerance or the like is suppressed.

Moreover, as illustrated in FIG. 7, in the recording apparatus 1 of this embodiment, the position of the output tray 4 can be changed along arrow direction A to, for example, a position of an output tray 4-1 illustrated by solid lines and a position of an output tray 4-2 illustrated by imaginary lines in accordance with the thickness of the stacked sheet P. That is, the recording apparatus 1 of this embodiment includes a lifting/lowering mechanism 52 of the output tray 4 that can make a distance L from the output roller pair 25 to the sheet P stacked on the top constant. In this case, under the control by the control unit 9, the lifting/lowering mechanism 52 can adjust the position of the output tray 4 such that the restricting member 51 in contact with the sheet P stacked on the output tray 4 at the contact position illustrated in FIG. 5 or other figures is bent and rotatable. That is, the recording apparatus 1 of this embodiment can adjust the position of the output tray 4 such that the flexible restricting member 51 located at the contact position is bent and rotatable. Accordingly, the recording apparatus 1 of this embodiment can smoothly rotate the restricting member 51 for effectively suppressing deformation along the output direction D of a stacked sheet P by the restricting member 51, and for suppressing deformation along the output direction D of a sheet P to be newly stacked.

The recording apparatus 1 of this embodiment includes the casing portion 53 that houses the recording head 8 as illustrated in FIGS. 1 and 2. The output tray 4 and the lifting/lowering mechanism 52 are housed inside an external shape that is defined by the casing portion 53. Thus, with the recording apparatus 1 of this embodiment, for example, contact of the output tray 4 with an external object along with movement, that is, lifting or lowering of the output tray 4 can be suppressed.

In addition, as described above, the output tray 4 of this embodiment has the rib 4*a* that is provided at the center portion in the width direction W and that extends along the output direction D. The pressing members 50 of this embodiment can press a sheet P toward the output tray 4 at both sides of the rib 4*a* in the width direction W, and bottom portions 50*b* of the pressing member 50 can be displaced to a position lower than a top portion of the rib 4*a*. Thus, the recording apparatus 1 of this embodiment suppresses deformation of a sheet P and increases stacking efficiency for sheets P, by stacking a sheet P while forming a curved shape extending along the output direction D.

Described next is an output operation flow of a recording medium, in other words, a stack flow of a sheet P on the output tray 4, to be performed using the recording apparatus 1 of this embodiment with reference to FIGS. 3, 8 to 14, and 15.

Figure 8:
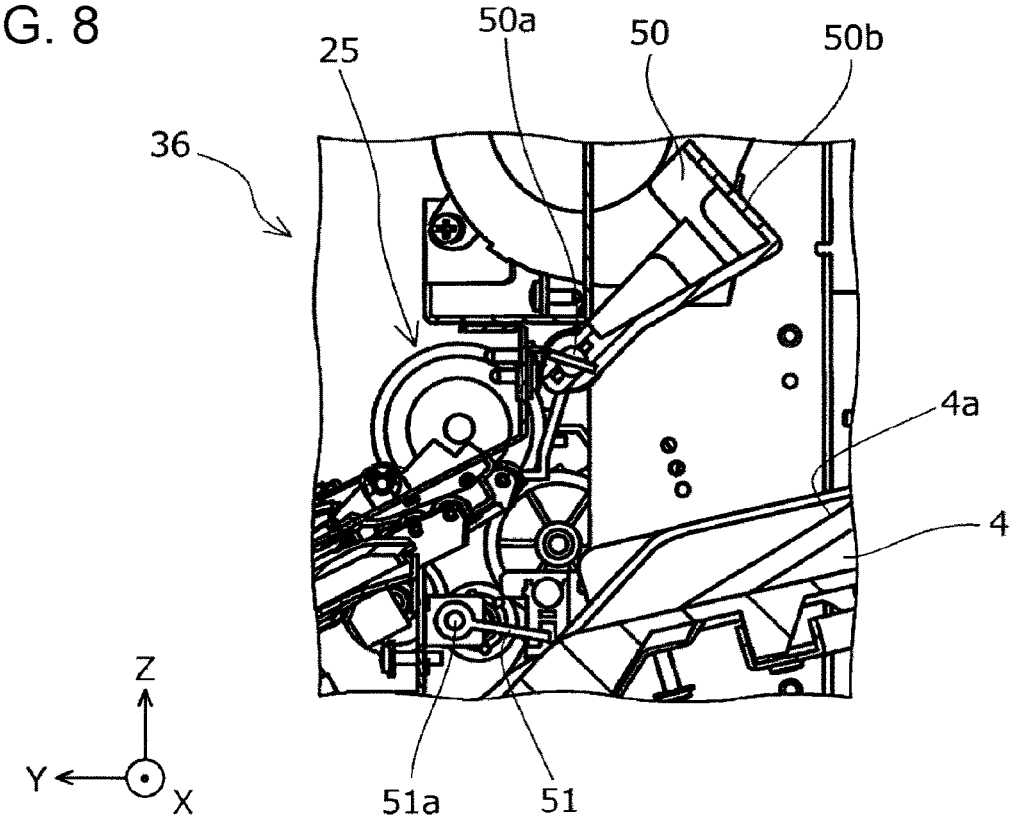
FIG. 8 is a schematic front sectional view of the recording apparatus according to the embodiment of the present disclosure.
Figure 9:
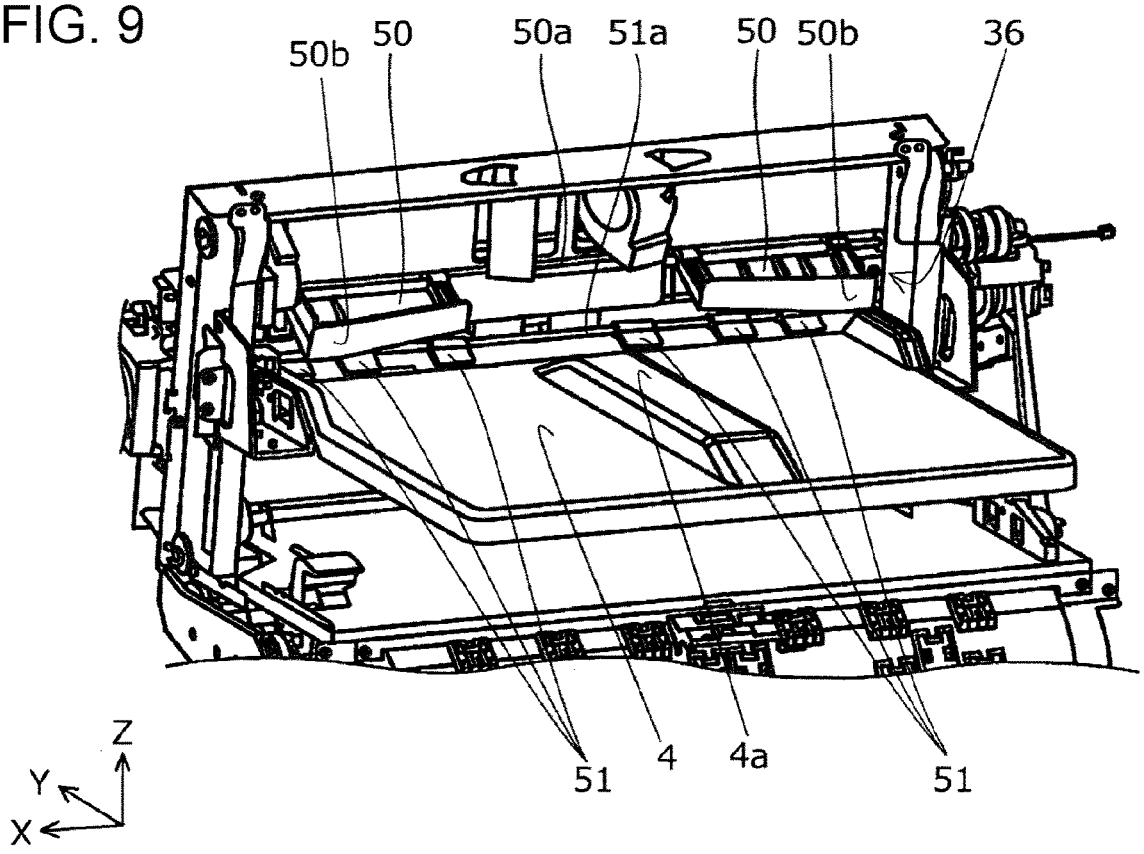
FIG. 9 is a schematic perspective view of the recording apparatus according to the embodiment of the present disclosure.
Figure 10:
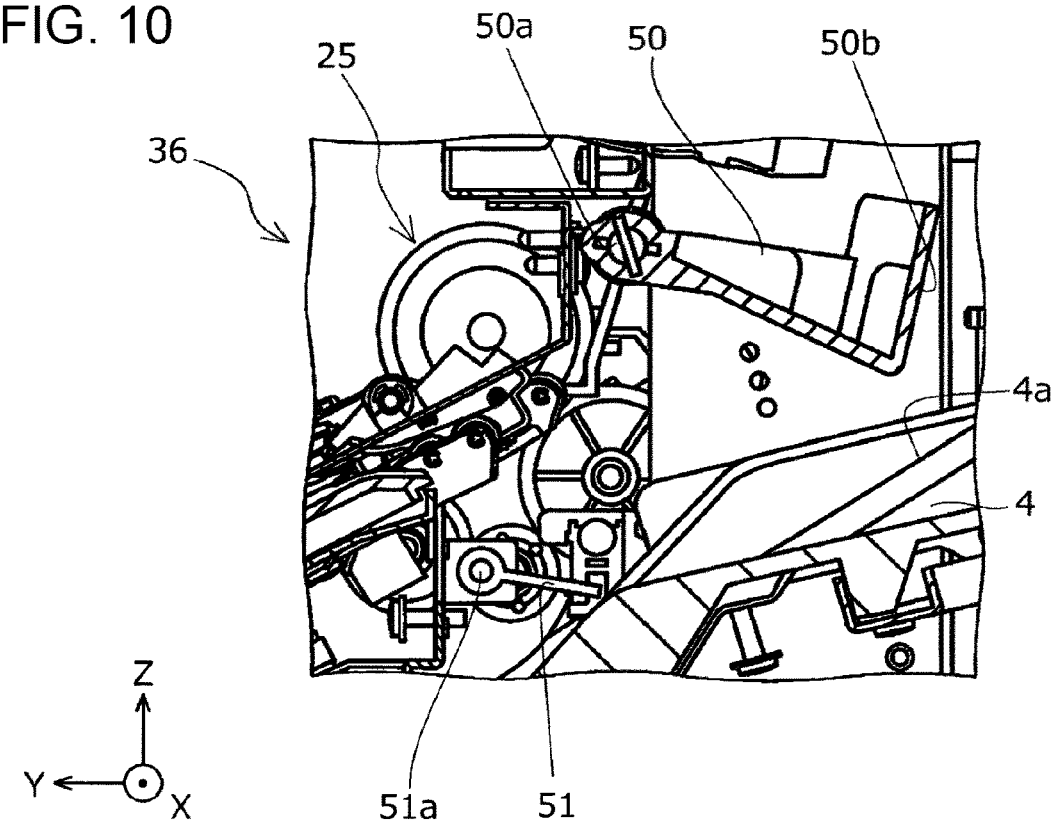
FIG. 10 is a schematic front sectional view of the recording apparatus according to the embodiment of the present disclosure.
Figure 11:
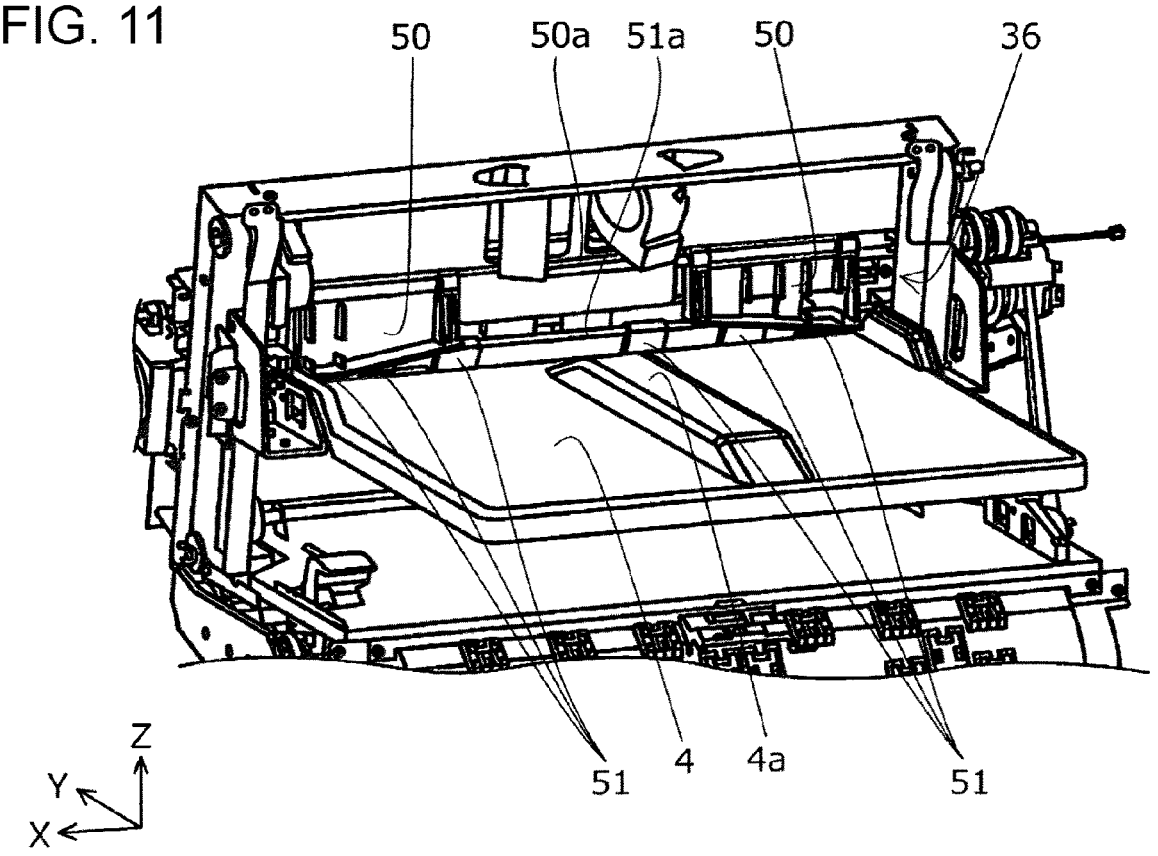
FIG. 11 is a schematic perspective view of the recording apparatus according to the embodiment of the present disclosure.
Figure 12:
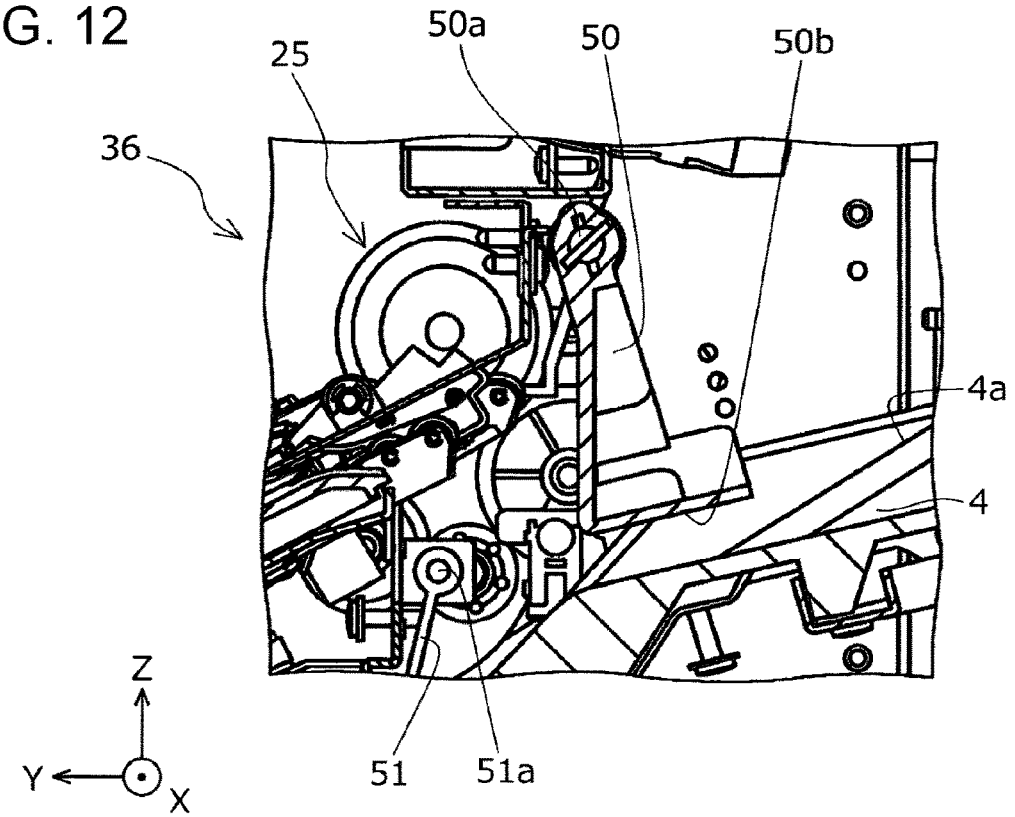
FIG. 12 is a schematic front sectional view of the recording apparatus according to the embodiment of the present disclosure.
Figure 13:
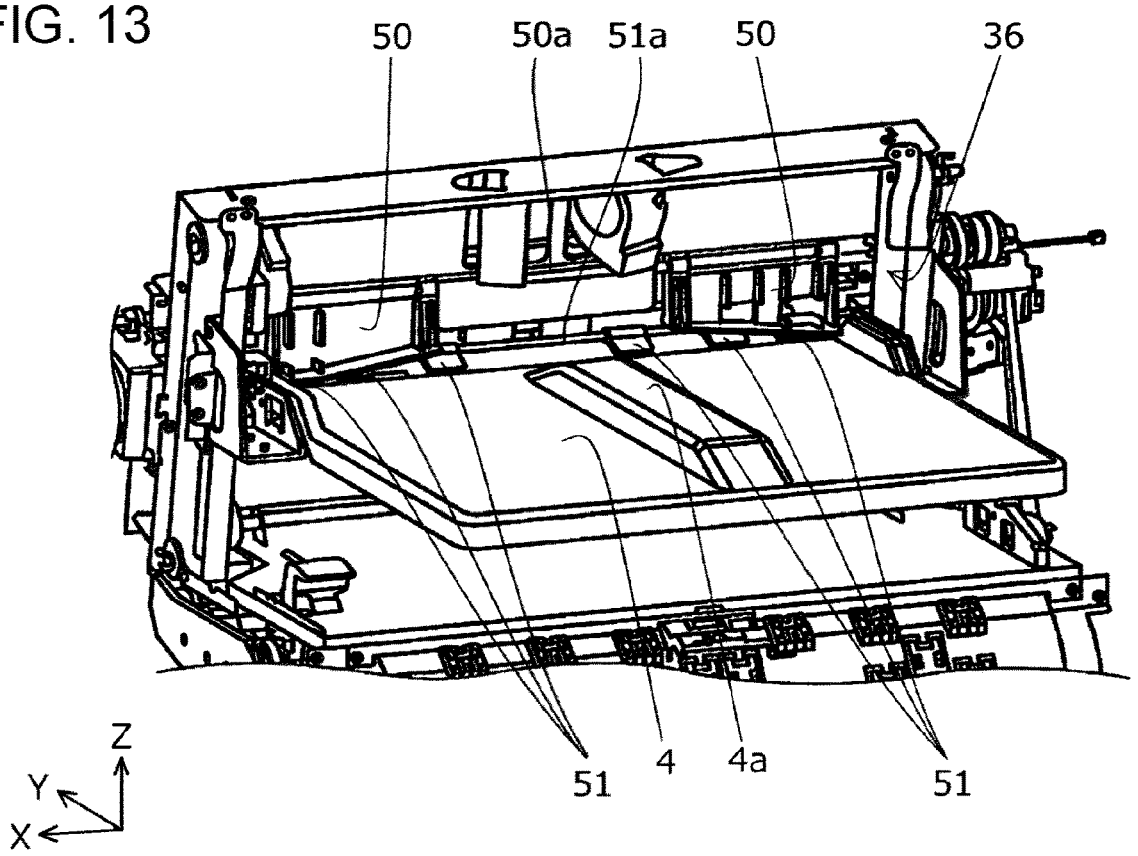
FIG. 13 is a schematic perspective view of the recording apparatus according to the embodiment of the present disclosure.
Figure 14:
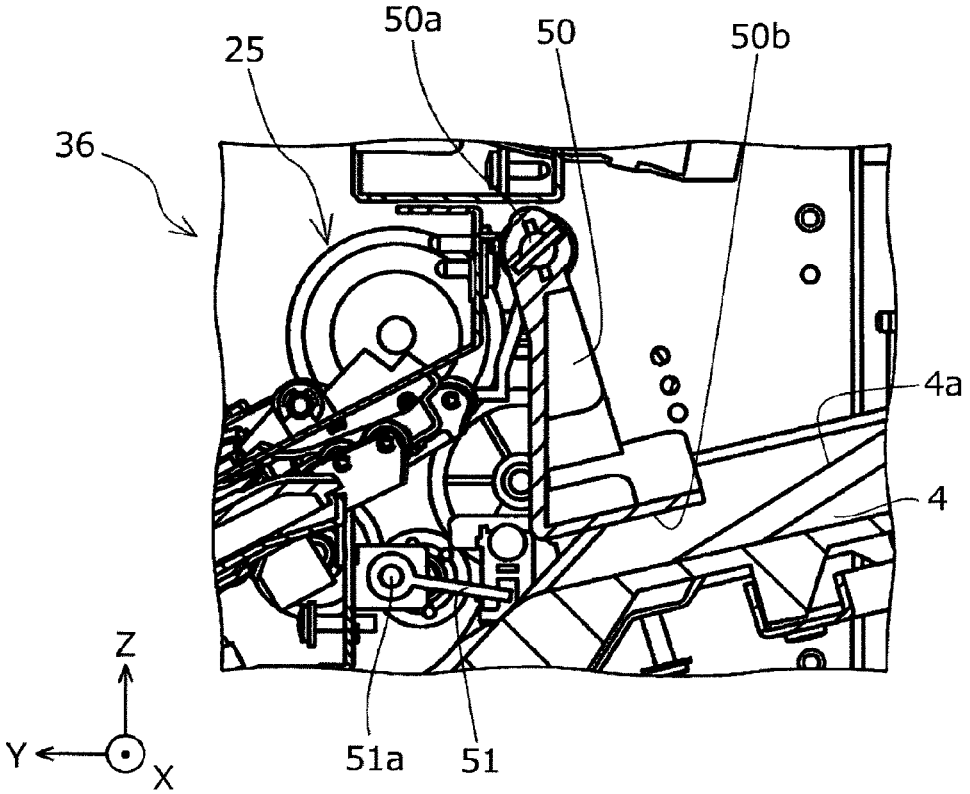
FIG. 14 is a schematic front sectional view of the recording apparatus according to the embodiment of the present disclosure.

Although mentioned above, FIG. 3 is a schematic perspective view of the recording apparatus 1 of this embodiment. FIG. 3 illustrates, for example, a state in which, when a sheet P is stacked on the output tray 4, the output mechanism unit 36 starts outputting a new sheet P. FIG. 8 is a schematic front sectional view of the recording apparatus 1 of this embodiment, and illustrates the state corresponding to FIG. 3. FIG. 9 is a schematic perspective view of the recording apparatus 1 of this embodiment. FIG. 9 illustrates a state in which output of the sheet P progresses from the state corresponding to FIG. 3, the pressing member 50 is located at the pressing position at which the pressing member 50 can press the sheet P, and the output mechanism unit 36 outputs the sheet P to the output tray 4. FIG. 10 is a schematic front sectional view of the recording apparatus 1 of this embodiment, and illustrates the state corresponding to FIG. 9. FIG. 11 is a schematic perspective view of the recording apparatus 1 of this embodiment, and illustrates a state which has further progressed from the state corresponding to FIG. 9. In this state, the pressing member 50 is located at the restricting position at which the pressing member 50 can restrict a sheet P, and the restricting member 51 is temporarily rotated and retracted so that the restricting member 51 restricts a sheet P output from the output mechanism unit 36 and newly stacked on the output tray 4. FIG. 12 is a schematic front sectional view of the recording apparatus 1 of this embodiment, and illustrates the state corresponding to FIG. 11. FIG. 13 is a schematic perspective view of the recording apparatus 1 of this embodiment, and illustrates a state which has further progressed from the state corresponding to FIG. 11. In this state, in preparation for temporary displacement of the pressing member 50 upward to output a further new sheet P, the restricting member 51 is rotated again to the contact position and the restricting member 51 restricts a sheet P stacked on the output tray 4. FIG. 14 is a schematic front sectional view of the recording apparatus 1 of this embodiment, and illustrates the state corresponding to FIG. 13.

FIGS. 3, 8 to 10, 13, and 14 illustrate the state in which the restricting member 51 is at the contact position. FIGS. 11 and 12 illustrate the state in which the restricting member 51 is not at the contact position.

FIGS. 3, and 8 to 14 omit the sheet P for easier understanding of arrangement of the pressing member 50 and the restricting member 51.

Figure 15:
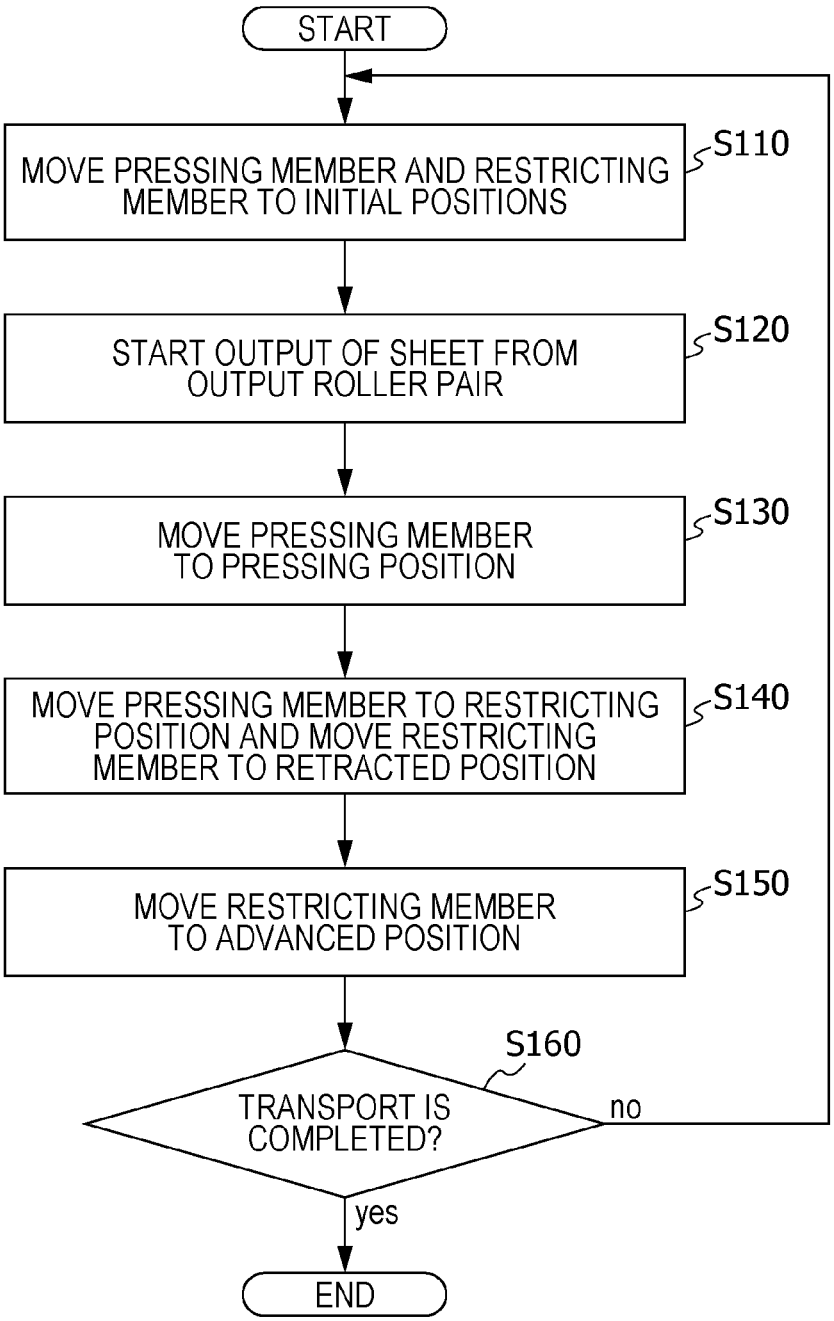
FIG. 15 is a flowchart presenting an example of an output operation flow for a recording medium using the recording apparatus according to the embodiment of the present disclosure.

FIG. 15 is a flowchart presenting an example of an output operation flow for a recording medium using the recording apparatus 1 according to this embodiment.

As illustrated in FIG. 15, when the output operation flow of a recording medium of this example is started, first in step S110, the pressing member 50 and the restricting member 51 are moved to initial positions. In this case, as illustrated in FIGS. 3 and 8, the initial position of the pressing member 50 is a position at which the pressing member 50 is entirely located above the output roller pair 25, or in other words, a position at which the pressing member 50 does not contact a sheet P output from the output roller pair 25. The initial position of the restricting member 51 is the contact position, or in other words, a position at which the restricting member 51 can contact the upstream end portion Pe of the sheet P stacked on the output tray 4. When the pressing member 50 and the restricting member 51 have been at the initial positions before this step is started, the pressing member 50 and the restricting member 51 are not moved in this step.

Then, in step S120, output of a sheet P from the output roller pair 25 is started. In this case, immediately after output of a sheet P is started from the output roller pair 25, the pressing member 50 and the restricting member 51 are located at the initial positions as illustrated in FIGS. 3 and 8.

Then, in step S130, the pressing member 50 is moved downward to move the pressing member 50 to the pressing position, or in other words, a position at which the pressing member 50 can press the sheet P (specifically, the upstream end portion Pe) output from the output roller pair 25 toward the output tray 4. The pressing position of the pressing member 50 is a position in the state illustrated in FIGS. 9 and 10. More specifically, in a case where a sheet P is noticeably deformed to be curved in a view in the width direction W, the pressing position of the pressing member 50 is a position at which the pressing member 50 can contact the upstream end portion Pe of the sheet P output on the output tray 4 and having a curved shape extending along the output direction D and protruding upward. During execution of this step, the restricting member 51 is continuously located at the initial position (the advanced position).

Then, in step S140, the pressing member 50 is further moved downward to move the pressing member 50 to the restricting position, or in other words, a position at which the pressing member 50 can press the sheet P (specifically, the upstream end portion Pe) stacked on the output tray 4 toward the output tray 4 and hence can restrict the sheet P. Further in this step, the restricting member 51 is moved to the retracted position rotated and retracted from the contact position, or in other words, a position at which the restricting member 51 does not contact the sheet P stacked on the output tray 4. In this case, the restricting position of the pressing member 50 and the retracted position of the restricting member 51 are positions in the state illustrated in FIGS. 11 and 12. In the output operation flow of a recording medium of this example, the pressing member 50 is moved to the restricting position simultaneously when the restricting member 51 is moved to the retracted position. However, the pressing member 50 may be moved to the restricting position before the restricting member 51 is moved to the retracted position. In addition, during transition from step S130 to step S140, the pressing member 50 may be temporarily stopped at the pressing position, or the pressing member 50 may be continuously moved from the initial position to the restricting position.

Then, in step S150, as illustrated in FIGS. 13 and 14, the restricting member 51 is moved to the contact position. That is, the restricting member 51 is rotated by one turn in the rotation direction Rb in a period from the start of step S140 to the end of step S150. In step S140, a sheet P stacked on the top is restricted only by the pressing member 50. When this step is executed, the sheet P stacked on the top is restricted also by the restricting member 51.

Then, in step S160, it is determined whether a further new sheet P is transported, that is, whether a further new sheet P is output on the output tray 4. When it is determined that a further new sheet P is transported, the flow returns to step S110. When it is determined that transport of a sheet P is completed, the output operation flow of a recording medium of this example is ended. That is, when a single sheet P is output, step S110 to step S160 are performed once, and when a plurality of sheets P are output, step S110 to step S160 are repetitively performed by the number of sheets P. When the flow returns from step S160 to step S110, the pressing member 50 moves upward. While the flow returns from step S160 to step S110, the restriction on the sheet P by the pressing member 50 is released, but the restriction on the sheet P by the restricting member 51 is kept.

As described above, in the output operation flow of a recording medium of this example, a sheet P stacked on the output tray 4 is constantly restricted by at least one of the pressing member 50 and the restricting member 51. Thus, the output operation flow of a recording medium of this example can suppress a decrease in stacking efficiency because a sheet P stacked on the output tray 4 is not restricted for a certain period of time and the sheet P is deformed.

In addition, as described above, when a sheet P is noticeably deformed to be curved in a view in the width direction W, the pressing position of the pressing member 50 in step S140 is a position at which the pressing member 50 can contact the upstream end portion Pe of the sheet P output on the output tray 4 and having a curved shape extending along the output direction D and protruding upward.

That is, the pressing member 50 in the recording apparatus 1 of this embodiment is displaced to the pressing position at which the pressing member 50 can contact the upstream end portion Pe of the sheet P having a curved shape, and hence the pressing member 50 can press the upstream end portion Pe. Accordingly, the recording apparatus 1 of this embodiment can effectively suppress deformation of the sheet P along the output direction D, and can increase stacking efficiency for sheets P, by pressing the upstream end portion Pe toward the output tray 4.

In addition, the restricting member 51 is configured to rotate from the contact position, that is, configured to be retracted along with the displacement of the pressing member 50 to the pressing position. Accordingly, the recording apparatus 1 of this embodiment can suppress occurrence of an unpressed state of a sheet P by retracting the restricting member 51 after the sheet P is pressed by the pressing member 50.

In addition, like step S150 described above, the pressing member 50 in the recording apparatus 1 of this embodiment is displaced to the restricting position located below the pressing position, and hence can restrict deformation of the upstream end portion Pe. Accordingly, the recording apparatus 1 of this embodiment can effectively suppress deformation of the sheet P along the output direction D and can increase stacking efficiency for sheets P, by restricting the deformation of the upstream end portion Pe using the pressing member 50.

In addition, the restricting member 51 is configured to rotate to the contact position along with the displacement of the pressing member 50 to the restricting position. Accordingly, the recording apparatus 1 of this embodiment can restrict deformation of a newly stacked sheet P using the restricting member 51 by arranging the restricting member 51 at the contact position after the sheet P is restricted by the pressing member 50.

The present disclosure is not limited to the above-described embodiment, various modifications can be made within the scope of the disclosure described in the claims, and the modifications are included in the scope of the disclosure.

For example, the timings at which the pressing member 50 and the restricting member 51 are moved, and further whether the pressing member 50 and the restricting member 51 are moved or not may be changed in accordance with, for example, the size of a sheet P to be used or the density of ink to be ejected on a sheet P. In addition, a sensor that can detect the position of the upstream end portion Pe may be provided. The timings at which the pressing member 50 and the restricting member 51 are moved, and further whether the pressing member 50 and the restricting member 51 are moved or not may be changed in accordance with the detection result of the sensor.

What is claimed is:

1. A recording apparatus comprising:

a recording head that performs recording by ejecting liquid on a recording medium;

an output unit that outputs the recording medium on which the recording was performed by the recording head;

an output tray that receives, from below, the recording medium output from the output unit in an output direction;

a pressing member that is configured to be displaced in an up-down direction and that presses the recording medium toward the output tray by displacement of the pressing member from an upper side to a lower side with respect to the recording medium output from the output unit; and a restricting member configured to contact, from above, an upstream end portion in the output direction of the recording medium pressed by the pressing member, the restricting member including a contact position with respect to the upstream end portion being configured to rotate, wherein:

the pressing member presses the recording medium before the restricting member is in contact with the recording medium, when the pressing member moves from an upper side to a lower side, the restricting member moves from the contact position to a retracted position, then moves from the retracted position to the contact position, the restricting member restricts deformation of the upstream end portion in the output direction of the recording medium pressed by the pressing member at the contact position, and the pressing member is displaced upward in a state in which the restricting member restricts the deformation of the upstream end portion.

2. The recording apparatus according to claim 1, wherein during the displacement of the pressing member from the upper side to the lower side with respect to the recording medium, end portions of the pressing member are lower than a center portion of the pressing member in a width direction intersecting with the output direction, the pressing member is in contact with the recording medium being output from the output unit from above, and hence the pressing member is configured to form a curved shape protruding upward in a view in the output direction at the recording medium.

3. The recording apparatus according to claim 2, wherein the pressing member is configured to press the upstream end portion of the recording medium toward the output tray by displacement of the pressing member from a position at which the pressing member contacts the recording medium having the curved shape to a pressing position, and the restricting member is configured to rotate from the contact position along with the displacement of the pressing member to the pressing position.

4. The recording apparatus according to claim 3, wherein the pressing member is configured to restrict the deformation of the upstream end portion by displacement of the pressing member to a restricting position that is lower than the pressing position, and the restricting member is configured to rotate to the contact position along with the displacement of the pressing member to the restricting position.

5. The recording apparatus according to claim 1, wherein the restricting member is flexible.

6. The recording apparatus according to claim 5, further comprising:

a lifting/lowering mechanism of the output tray, wherein the lifting/lowering mechanism is configured to adjust a position of the output tray such that the restricting member in contact with the recording medium stacked on the output tray is flexible and rotatable at the contact position.

7. The recording apparatus according to claim 6, further comprising:

a casing portion that houses the recording head, wherein the output tray and the lifting/lowering mechanism are housed in the casing portion.

8. The recording apparatus according to claim 1, wherein the output tray has a rib that is provided at a center portion of the output tray in a width direction intersecting with the output direction and that extends along the output direction, and the pressing member is configured to press the recording medium toward the output tray at both sides of the rib in the width direction, the both sides being configured to be displaced to a position lower than a top portion of the rib.

* * * * *